United States Patent [19]

Ianitelli et al.

[11] Patent Number: 4,612,434

[45] Date of Patent: Sep. 16, 1986

[54] CLOSED LOOP HUMIDIFIER FOR INSTITUTIONS

[76] Inventors: Pingree Ianitelli, 11417 Savage Dr., Sterling Heights, Mich. 48077; Kerry G. Fleury, 22400 Beechwood, East Detroit, Mich. 48021

[21] Appl. No.: 670,003

[22] Filed: Nov. 13, 1984

[51] Int. Cl.[4] ..... F22B 1/28

[52] U.S. Cl. ..... 219/273; 219/271; 219/362; 126/113

[58] Field of Search ..... 219/271, 273, 272, 274, 219/275, 276, 362; 126/113, 369; 236/44 R; 261/142, DIG. 65; 122/4 A, 13 A

[56] References Cited

U.S. PATENT DOCUMENTS

| | | | |
|---|---|---|---|
| 1,532,086 | 3/1925 | Shroyer | 219/401 |
| 1,676,763 | 7/1928 | Anetsberger | 126/369 |
| 1,846,233 | 2/1932 | Van Daam | 219/362 |
| 2,133,599 | 10/1938 | Turney | 126/113 |
| 2,182,836 | 12/1939 | Zummach | 219/362 |
| 2,753,433 | 7/1956 | Rutkowski | 219/362 |
| 2,784,466 | 3/1957 | Burns | 219/272 |
| 3,222,498 | 12/1965 | Mitsch | 219/271 |
| 3,834,385 | 9/1974 | Pekkarinen | 261/DIG. 65 |

FOREIGN PATENT DOCUMENTS

| | | | |
|---|---|---|---|
| 2364216 | 6/1975 | Fed. Rep. of Germany | 219/362 |
| 1550315 | 12/1968 | France | 126/113 |

*Primary Examiner*—Clarence L. Albritton
*Assistant Examiner*—Teresa Walberg
*Attorney, Agent, or Firm*—Harry R. Dumont

[57] ABSTRACT

A humidifier system for use in hospitals or other health institutions. The humidifier is a two-compartment system connected by horizontal pipes with a closed-loop arrangement that keeps the distilled water used in the system out of contact with the environment and further isolates the vapor being generated by heating coil from the outside environment. An electrically controlled system provides for automatic feed of water to the second compartment where vaporizing is provided.

6 Claims, 3 Drawing Figures

CLOSED LOOP HUMIDIFIER FOR INSTITUTIONS

BACKGROUND OF THE INVENTION

There exists a problem which with respect to humidifiers that are being used in a hospital or other institutional health locales. The environment there may contain a variety of harmful bacteria that are circulated and re-circulated through humidifiers in which there is open communication between the air in the environment and the water or water vapor used in the system. The most commonly used humidifier systems incorporate a fan to circulate not only vapor but droplets of moisture which are entrapped in the air flow and passed about in the external environment. Systems of this type further have the problem of concentrating moisture in areas or on wall surfaces thus encouraging mold and the growth of additional bacteria in parts of the environment.

Humidifier systems in which evaporation of water vapor and water droplets are made from an open outlet are known in the prior art. One such system is shown in U.S. Pat. No. 2,211,407 issued on Aug. 13, 1940 to H. Christenson for "Portable Vaporizer." That humidifier uses a multiple compartment arrangement but allows an open top of the boiler to emit the vapor thus allowing free intercommunication between the atmospheric environment and the water in the system.

A still further automatically operated humidifier is shown and described in U.S. Pat. No. 1,791,313 issued Feb. 3, 1931 to W. F. Hillpot for "Automatically Operative Humidifier." This system incorporates a number of horizontally arrayed pans and heaters, but once again the vapor being emitted and the water in the system are in communication with the atmosphere during its operation.

An additional system for medicating and vaporizing the atmosphere is shown in U.S. Pat. No. 2,070,378 issued on Feb. 9, 1937 to A. B. Stout for "Medicated Steam Bath." The humidifier system shown in this patent once again has the drawback of having openings and providing free inter-communication between water in the humidifier and the air in the atmosphere.

SUMMARY OF THE INVENTION

The present invention will be seen to provide an improved humidifier system particularly adaptable for use in a hospital or other institutions in which there may be present in the atmosphere harmful bacteria and other materials which it is desirable to keep away from the water supply used in the humidifier system. The present invention employs a pair of compartments, one for holding distilled water and the other for vaporizing water and the two are interconnected by upper and lower conduits for providing a closed loop system between the two compartments. Water is provided to the vaporizing compartment when the vapor is passed outwardly and upwardly through a panel of vapor permeable material at the top of the vaporizing compartment. Excess vapor is permitted to pass back into the distilled water compartment where it is returned to the liquid condition. The panel is fitted in the top of the vaporizing compartment, is known by the tradename "Gortex" and is manufactured and sold by W. L. Gore and Associates, Inc., of ELKTON, Maryland. The physical characteristics of the Gortex material are such that it is a microporous membrane and has a fiber size and orientation that permits the free passage of vapor molecules but not of the larger water molecules. Consequently, all the water is kept in the closed loop system and only fine water vapor is emitted through the Gortex material to the room.

BRIEF DESCRIPTION OF THE DRAWING

The present invention will now be described in the accompanying specification and in the drawings, in which.

DETAILED DESCRITION OF THE PREFERRED EMBODIMENT

Figure 1:
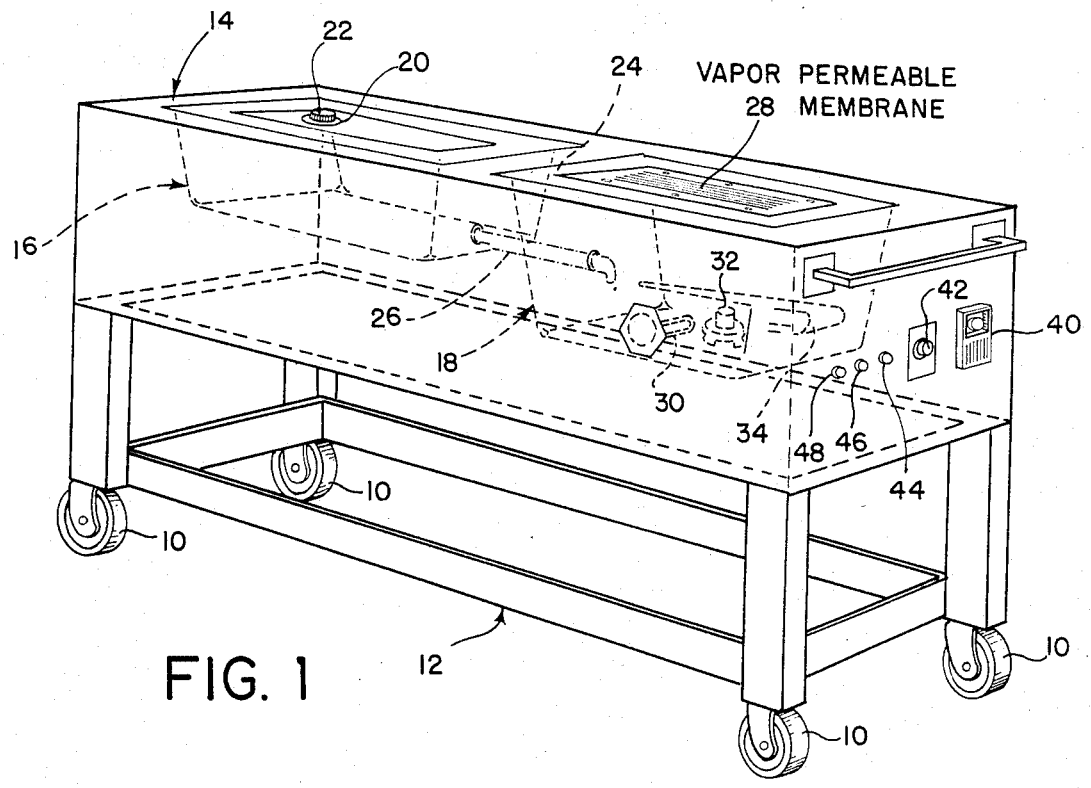
FIG. 1 is a perspective view of the humidifier unit showing its important components.

FIG. 1 shows a plurality of rollers 10 attached to the legs of a cart 12 that form a part of the portable humidifier according to the present invention. The upper enclosure 14 supports a pair of laterally spaced compartments 16 and 18. The compartment 16 is a water holding compartment while compartment 18 is the water vaporizing compartment The inlet to the water compartment 16 is normally covered except when water is being added. It comprises a inlet 20 which is capped by a sealing cap 22 after water has been added to the system. An upper pipe 24 and a lower pipe 26 communicate between the respective compartments 16 and 18. The upper surface of the vaporizing compartment 18 has fastened to it a panel 28 of vapor permeable material. As previously stated, the panel 28 allows escape in an upper direction of vapor molecules but at the same time restrains the passage of larger water molecules which are passed rightwardly through the upper conduit 24 and returned to the water compartment 16.

Figure 2:
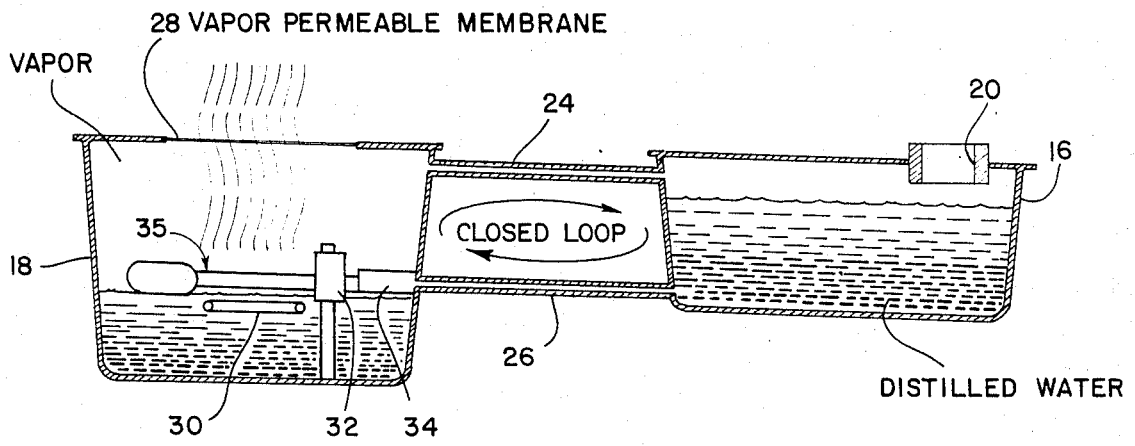
FIG. 2 is a schematic drawing further clarifying and showing the operation of the humidifier.

An automatic control system is included which maintains the necessary water levels in the vaporization compartment 18 during operation. The several important elements of the system include a heater 30, a water level switch 32, and a float valve 34 as shown in FIGS. 1 and 2. The float valve operator 35 is pivotably mounted on the water level switch 32 and, responsive to input of water through the lower conduit 26, it operates to open and close the flow of water from conduit 26 into the vaporization chamber 18.

Figure 3:
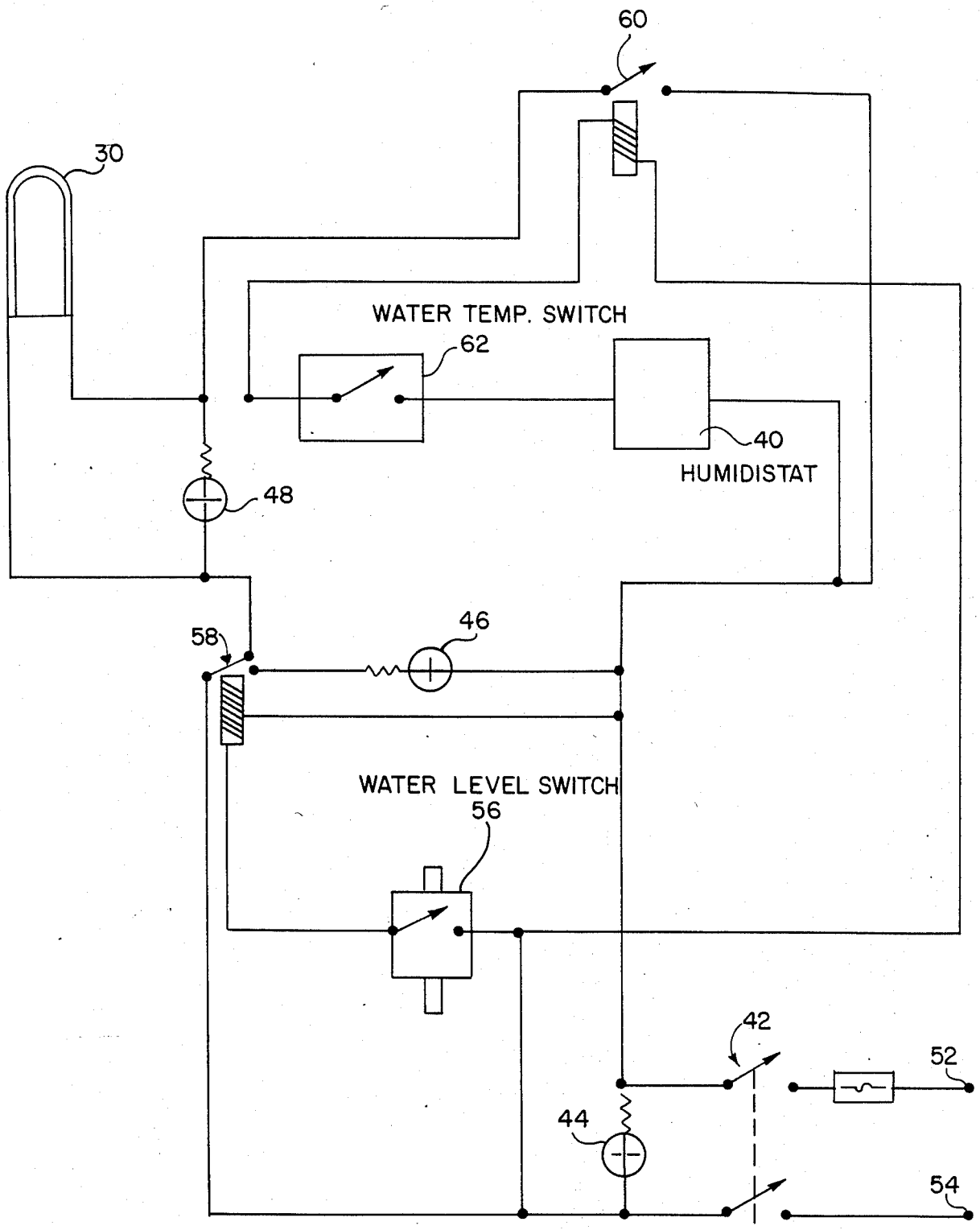
FIG. 3 is a electrical schematic showing the control circuit that operates the humidifer.

FIG. 3 shows the electrical control system for the humidifier of FIG. 1. An end panel at the right hand end of FIG. 1 shows the associated parts externally mounted on the unit which include a humidistat 40 and its associated switch, a power-on switch 42, a power-on lamp 44 of the amber type, a red water level lamp 46 and a green cycle-on lamp green indicated by the numeral 48.

A cycle of operation will now be described with reference to the control circuit shown in FIG. 3. The power-on switch 42 is a double throw, double pole switch connected to a power input terminals shown as AC source 52, 54. Associated with the power-on switch 42 is the power-on lamp which is amber in color and identified by the numeral 44. Also included is the water level switch 56 which is normally open and in circuit with a relay 58 that is activated to control water level. A water level lamp 46 is shown which is red in color when illuminated.

A second control relay 60 is shown operatively connected to the water temperature switch 62 and to the humidistat 40. The heating element 30 that is used to heat the water introduced to the vaporization compartment 18 is also shown at the upper left-hand side of the FIG. 3 drawing. Connected across the heating element 30 is a cycle-on lamp 48 which is green in color which is already indicated in connection with FIG. 1.

In the operation of the humidifier, distilled water is poured into the compartment 16. It passes through the lower pipe 26 and begins to fill the compartment 18. The float valve 34 will remain open until the water level in the compartment 18 reaches a predetermined level. The tank inlet at the left-hand of the conduit 26 is then closed. The humidifier unit is then turned on by the power-on switches 42 and the amber indicator switch lamp 44 for the power-on switches are lit. The water level lamp 46 formerly illuminated red becomes extinguished since water is at the correct level for operation. If the water is not at the correct level in the compartment 18, then the float switch 56 will energize, the the relay 58 will be energized causing lamp 46 to be lighted red and also to deenergize the rest of the circuit. The humidistat 40 is used to sense the moisture in the compartment and it will close at a preset value. The humidistat 40 is in series with the water temperature switch 62 and remains closed when water is less than about 120 degrees. It will however open at 140 degrees. When both the humidistat 40 and the water temperature switch 62 are closed, the relay 60 will energize causing the cycle-on lamp 48 to be turned on green. The heater 30 will be energized causing the water in the compartment 18 to vaporize and to be emitted through the vapor permeable panel 28 at the top of the compartment.

It will thus be seen that we have provided a substantially improved humidifier that is adapted for use in a hospital or institutional environment. Warm vapor is circulated with much better results than air blown water droplets. The vapor becomes more uniformally distributed in the environment and will not create dense areas of water where bacteria can flourish. Even more importantly, elimination of a fan in the system stops drafts in the room. The unit is preferably constructed of stainless steel for easy cleaning, durability and appearance.

We claim:

1. A humidifier for providing an output of warm vapor, comprising;

a water storage compartment for receiving and holding a quantity of distilled water;

a vaporization compartment connected to said storage compartment through two lateral conduits, one above another, to provide a closed loop circulation between said compartments;

a vapor permeable panel included in an upper surface of the vaporization compartment; and a means for heating water passed from the water storage compartment to the vaporization compartment to provide operation of the humidifier; and said panel is of a microporous material of a fiber size and orientation that permits free passage of vapor molecules to ambient but not of larger water molecules.

2. The combination as set forth in claim 1 in which a float valve is pivotably mounted in said vaporization compartment in communication with the lower one of said conduits for controlling flow of distilled water into the vaporization compartment.

3. The combination as set forth in claim 1 wherein a water level switch is included in said vaporization compartment for predetermining the level of fill from the water storage compartment.

4. The combination as set forth in claim 1 in which said compartments are each fabricated of stainless steel.

5. The combination as set forth in claim 1 in which said compartments are mounted in a common enclosure and in which said enclosure is supported by a cart and a plurality of rollers for making the humidifier portable.

6. The combination as set forth in claim 1 in which said water storage compartment is normally closed during operations by a sealing cap.

* * * * *